US009541288B2

(12) United States Patent
Pastore

(10) Patent No.: US 9,541,288 B2
(45) **Date of Patent: *Jan. 10, 2017**

(54) PROCESS FOR OPERATING A FURNACE WITH BITUMINOUS COAL AND METHOD FOR REDUCING SLAG FORMATION THEREWITH

(71) Applicant: ENVIRONMENTAL ENERGY SERVICES, INC., Sandy Hook, CT (US)

(72) Inventor: Mark Pastore, Suffern, NY (US)

(73) Assignee: Environmental Energy Services, Inc., Sandy Hook, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/846,913

(22) Filed: Sep. 7, 2015

(65) Prior Publication Data

US 2015/0377483 A1 Dec. 31, 2015

Related U.S. Application Data

(63) Continuation of application No. 13/350,412, filed on Jan. 13, 2012, now Pat. No. 9,127,228.

(Continued)

(51) Int. Cl.
*F23B 90/00* (2011.01)
*F23J 7/00* (2006.01)

(Continued)

(52) U.S. Cl.
CPC .. *F23J 7/00* (2013.01); *C10L 5/04* (2013.01); *C10L 9/10* (2013.01); *C10L 10/04* (2013.01);

(Continued)

(58) Field of Classification Search
CPC ..... C10L 10/04; C10L 5/04; C10L 2200/0272; C10L 2200/029; C10L 2200/0213; C10L 9/10

(Continued)

(56) References Cited

U.S. PATENT DOCUMENTS 2,800,172 A 7/1957 Romer et al.
2,845,338 A 7/1958 Ryznar et al.

(Continued)

FOREIGN PATENT DOCUMENTS

| | | |
|---|---|---|
| DE | 3429584 | 4/1985 |
| JP | 2004-083796 | 3/2004 |
| WO | 2009091539 | 7/2009 |

OTHER PUBLICATIONS

European Patent Office, "Extended European Search Report," European Patent Application No. 12734396.0, dated Feb. 18, 2015, 8 pages.

(Continued)

*Primary Examiner* — Kenneth Rinehart
*Assistant Examiner* — Bao D Nguyen
(74) *Attorney, Agent, or Firm* — Richard P. Gilly; Offit Kurman, P.C.

(57) ABSTRACT

There is provided a process for operating a coal-fired furnace to generate heat. The process has the steps of a) providing the coal to the furnace and b) combusting the coal in the presence of a first slag-reducing ingredient and a second slag-reducing ingredient in amounts effective to reduce slag formation in the furnace. In one embodiment, the first slag-reducing ingredient is one or more oxygenated magnesium compounds and the second slag-reducing ingredient is selected from the group consisting of one or more oxygenated calcium compounds, one or more oxygenated silicon compounds, and combinations thereof. In another (Continued)

embodiment, the first slag-reducing ingredient is one or more oxygenated silicon compounds, and wherein the second slag-reducing ingredient is one or more oxygenated aluminum compounds. There are also provided methods for reducing slag formation in a coal-fired furnace. There are also provided methods for treating coal. There are also treated coals.

18 Claims, 3 Drawing Sheets

Related U.S. Application Data

(60) Provisional application No. 61/578,034, filed on Dec. 20, 2011, provisional application No. 61/432,910, filed on Jan. 14, 2011.

(51) Int. Cl.

| | |
|---|---|
| ***C10L 10/04*** | (2006.01) |
| ***C10L 5/04*** | (2006.01) |
| ***C10L 9/10*** | (2006.01) |
| ***F23J 1/00*** | (2006.01) |
| ***F23K 1/00*** | (2006.01) |

(52) U.S. Cl.
CPC .. *F23J 1/00* (2013.01); *F23K 1/00* (2013.01); *C10L 2200/029* (2013.01); *C10L 2200/0213* (2013.01); *C10L 2200/0218* (2013.01); *C10L 2200/0272* (2013.01); *C10L 2290/141* (2013.01); *F23K 2201/505* (2013.01)

(58) Field of Classification Search
USPC ..... 110/342
See application file for complete search history.

(56) References Cited

U.S. PATENT DOCUMENTS

| | | | | |
|---|---|---|---|---|
| 4,280,817 | A | 7/1981 | Chauhan et al. | |
| 4,596,198 | A | 6/1986 | Greskovich et al. | |
| 4,654,164 | A | 3/1987 | Najjar | |
| 4,722,610 | A | 2/1988 | Levert et al. | |
| 4,953,481 | A | 9/1990 | Clayton | |
| 6,165,934 | A | 12/2000 | Gardner et al. | |
| 7,162,960 | B2 | 1/2007 | Smyrniotis et al. | |
| 7,430,969 | B2 | 10/2008 | Stowe, Jr. et al. | |
| 7,775,166 | B2 | 8/2010 | Aradi et al. | |
| 8,079,845 | B2 | 12/2011 | Nowak et al. | |
| 9,127,228 | B2 * | 9/2015 | Pastore | C10L 10/04 110/342 |
| 2006/0034743 | A1 | 2/2006 | Radway et al. | |
| 2006/0228282 | A1 | 10/2006 | Zhou et al. | |
| 2007/0044693 | A1 | 3/2007 | Smyrniotis et al. | |
| 2007/0168213 | A1 * | 7/2007 | Comrie | B01D 53/83 705/30 |
| 2008/0291965 | A1 | 11/2008 | Wolferseder | |
| 2009/0178599 | A1 * | 7/2009 | Pastore | F23D 1/00 110/343 |
| 2010/0006014 | A1 | 1/2010 | Smyrniotis et al. | |
| 2011/0269079 | A1 | 11/2011 | Wolferseder | |

OTHER PUBLICATIONS

International Preliminary Report of Patentability dated Jul. 16, 2013, for International Application No. PCT/US2012/021301, 8 pages.

International Search Report dated May 2, 2012, for International Application No. PCT/US2012/021301, 1 page.

Towell et al., "Improvements in Fuel Flexibility and Operating Cost Reduction at CSU Drake Station with Targeted In-Furnace Injection Technology," ASME 2010 Power Conference; Jul. 13-15, 2010, pp. 1-8.

Joseph R. Comparato, "Performance Improvement: Combustion and Heat Transfer Optimization," ACC PRB Coal Use Conference; Jul. 2007, pp. 1-12.

Smyrniotis et al., "Recent Catalyst Development Results and the Observed Affects on NOx, CO, LOI, CO2, and Slag;" Clean Air Europe Conference: Jul. 2007, pp. 1-12.

Smyrniotis et al., "Recent Catalyst Development Results and the Observed Affects on CO, LOI, and Slag;" Fuel Tech, Inc.; Clean Air Europe Conference: Jun. 2007, pp. 1-12.

Targeted In-Furnace Injection (TIFI); "Superior Control of Slag, Fouling Corrosion, Acid Plume," Fuel Tech, Inc., pp. 1-8.

Allery et al., "Demonstrated Performance Improvements on Large Lignite-Fired Boiler with Targeted In-Furnace Injection Technology," COAL-GEN 2010; Fuel Tech, Inc., Aug. 10-12, 2010, pp. 1-12.

Fuel Tech, Inc., Targeted In-Furnace Injection (TIFI); Oct. 5, 2010, pp. 1-3.

* cited by examiner

PROCESS FOR OPERATING A FURNACE WITH BITUMINOUS COAL AND METHOD FOR REDUCING SLAG FORMATION THEREWITH

CROSS-REFERENCE TO RELATED APPLICATIONS

The present application is a continuation application of and claims priority to U.S. patent application Ser. No. 13/350,412, filed Jan. 13, 2012. U.S. patent application Ser. No. 13/350,412 claims priority to U.S. Provisional Application 61/578,034, filed Dec. 20, 2011, and U.S. Provisional Application 61/432,910, filed Jan. 14, 2011. U.S. patent application Ser. No. 13/350,412, U.S. Provisional Application 61/578,034, and U.S. Provisional Application 61/432,910 are herein incorporated by reference in their entireties.

BACKGROUND OF THE DISCLOSURE

1. Field of the Disclosure

The present disclosure relates to a process for operating a furnace with a bituminous coal to generate heat. The present disclosure also relates to a method for reducing slag formation in a furnace. The present disclosure also relates to a method for treating coal. The present disclosure further relates to a treated coal.

2. Description of the Related Art

Slag builds up on the surfaces and/or walls of furnaces and boilers due to deposition of molten and/or semi-molten ash, which can in turn solidify. Particles of ash are normally molten when they exit the flame zone or radiant section of a boiler or furnace (the terms "furnace" and "boiler" are used interchangeably herein). If the melting point of the ash or the rate of solidification is too low, the particles will not have sufficient time to solidify before impinging on or contacting a surface within the boiler or furnace. When this occurs, the molten or plastic-like ash adheres to and solidifies on the surface, which gives rise to a slag deposit. Fouling can also occur in lower temperature convective sections of the boiler or furnace when volatile components in the ash, such as the alkali oxides, condense and collect further ash, which can sinter into a hard mass.

Typically, the composition and physical properties of ash found in prospective coal feedstocks are considered when designing the size and thermal dynamics of a boiler or furnace. Slag formation can be a particular problem when a coal feedstock is used in a boiler or furnace for which the boiler or furnace was not designed. The size and thermal dynamics of the boiler relative to the composition and physical properties of the ash in the coal feedstock will determine whether the ash is solid or molten by the time it reaches a surface. Desirably, the boiler or furnace is designed such that ash solidifies prior to reaching surfaces within the boiler or furnace. Such solidified ash can be removed relatively easily by means known in the art, such as by physical removal or blowing.

Slag formation occurs to some extent in all boiler and furnace systems. Boilers are often designed for some slag buildup on surfaces and walls to provide an additional measure of thermal insulation, and, thus, minimize heat loss through the walls. Excessive slag buildup, however, tends to clog the boiler or furnace and/or result in excessive temperatures therein.

Slag formation can have a major impact on boiler operation. Significant accumulation of slag can result in partial blockage of the gas flow, possibly requiring reduction in boiler load. Slag may build up to an extent that damage to tubing may result when attempting to dislodge heavy accumulations. Insulation of waterwall tubes may lead to a thermal imbalance within the boiler, heat transfer efficiency reductions, and excessively high temperatures in the superheat section.

Boilers are generally designed around a specified range of coal properties, depending on the expected source of fuel. Many consumers are forced to switch their normal supplies because of increased demand for coal. Additionally, more stringent regulations regarding emissions may make a change in fuel more desirable than adding control systems. Alternate coal supplies may be completely different from design fuel with regard to ash fusion temperature, ash composition, etc. Substitution of a coal with ash characteristics significantly different from those for which a boiler was designed can give rise to problems such as slagging.

Many factors are considered in designing a boiler capable of handling the ash characteristics of a particular coal. Design considerations are very important in determining whether deposits will form when a particular fuel is burned. Design considerations are geared to optimize the combustion process and reduce deposits to a minimum thus maximizing the efficiency of extraction of energy from the fuel. Careful control of the relative quantities absorbed through the various boiler sections is necessary.

A method commonly used in the art to reduce slag formation during on-line operations is soot blowing. However, soot blowing usually only partially alleviates the problem of slag formation.

Another method of reducing slag formation while on-line is to reduce boiler or furnace load. During reduction of boiler load, temperatures are reduced and molten ash solidifies faster, i.e., prior to reaching boiler/furnace walls. Also, the temperature reduction can cause a difference in contraction rates between metal in the tubes and the slag and cause slag to be separated from tube surfaces. Notwithstanding the foregoing, reduction of boiler load is economically undesirable due to lost capacity.

Another method used in the art to reduce slag formation while on-line is the use of attemperating spray, which reduces steam temperatures. As tubes begin to encounter slag formation, excessively high steam temperatures in the superheat and/or reheat sections of the boiler or furnace may necessitate the use of an attemperating spray. If slagging continues to increase, the amount of spray must be increased. Since the level of attemperating spray usage is proportional to the degree of slag formation, it can serve as a useful measure of the severity of the slag formation. When maximum spray is reached and steam temperatures are still too high, thermal balance can be restored by reducing load and shedding or removing slag.

A coal frequently used for the purpose of energy and electrical production is Illinois Basin (ILB) bituminous coal. A drawback to using ILB coal is that it typically exhibits a relatively low ash fusion temperature, which can result in elevated levels of slag formation in coal-fired furnaces.

It would be desirable to have a process for operating a coal-fired furnace exhibiting reduced slag formation. It would also be desirable to have a method for reducing slag formation in a coal-fired furnace. It would be desirable to have a method for treating coal. It would be desirable to have a treated coal that exhibits reduced slag formation when combusted. It would be particularly desirable to have the foregoing with respect to ILB coal.

SUMMARY OF THE DISCLOSURE

According to the present disclosure, there is provided a process for operating a coal-fired furnace to generate heat.

The process has the steps of a) providing the coal to the furnace and b) combusting the coal in the presence of a first slag-reducing ingredient and a second slag-reducing ingredient in amounts effective to reduce slag formation in the furnace. The first slag-reducing ingredient is selected from the group consisting of magnesium carbonate, magnesium hydroxide, magnesium oxide, magnesium sulfate, and combinations thereof. The second slag-reducing ingredient is selected from the group consisting of an oxygenated calcium compound, an oxygenated silicon compound, one or more oxygenated aluminum compounds, and combinations thereof.

Further according to the present disclosure, there is provided a method for reducing slag formation in a coal-fired furnace. The method has the step of combusting coal in the furnace in the presence of a first slag-reducing ingredient and a second slag-reducing ingredient in amounts effective to reduce slag formation in the furnace. The first slag-reducing ingredient is selected from the group consisting of magnesium carbonate, magnesium hydroxide, magnesium sulfate, magnesium oxide, and combinations thereof. The second slag-reducing ingredient is selected from the group consisting of one or more oxygenated calcium compounds, one or more oxygenated silicon compounds, one or more oxygenated aluminum compounds, and combinations thereof.

Further according to the present disclosure, there is a method for treating coal. The method has the step of introducing to the coal an amount of a first slag-reducing ingredient and an amount of a second slag-reducing ingredient. The first slag-reducing ingredient is selected from the group consisting of magnesium carbonate, magnesium hydroxide, magnesium sulfate, magnesium oxide, and combinations thereof. The second slag-reducing ingredient is selected from the group consisting of one or more oxygenated calcium compounds, one or more oxygenated silicon compounds, one or more oxygenated aluminum compounds, and combinations thereof.

Further according to the present disclosure, there is a treated coal. The treated coal is made up of the coal and an amount of an externally introduced first slag-reducing ingredient and an amount of an externally introduced second slag-reducing ingredient. The first slag-reducing ingredient is selected from the group consisting of magnesium carbonate, magnesium hydroxide, magnesium sulfate, magnesium oxide, and combinations thereof. The second slag-reducing ingredient is selected from the group consisting of one or more oxygenated calcium compounds, one or more oxygenated silicon compounds, one or more oxygenated aluminum compounds, and combinations thereof.

Further according to the present disclosure, there is provided another process for operating a coal-fired furnace to generate heat. The process has the steps of a) providing the coal to the furnace and b) combusting the coal in the presence of a first slag-reducing ingredient and a second slag-reducing ingredient in amounts effective to reduce slag formation in the furnace. The first slag-reducing ingredient is selected from among one or more oxygenated silicon compounds. The second slag-reducing ingredient is selected from among one or more oxygenated aluminum compounds.

Further according to the present disclosure, there is provided another method for reducing slag formation in a coal-fired furnace. The method has the step of combusting coal in the furnace in the presence of a first slag-reducing ingredient and a second slag-reducing ingredient in amounts effective to reduce slag formation in the furnace. The first slag-reducing ingredient is selected from among one or more oxygenated silicon compounds. The second slag-reducing ingredient is selected from among one or more oxygenated aluminum compounds.

Further according to the present disclosure, there is a method for treating coal. The method has the step of introducing to the coal an amount of a first slag-reducing ingredient and an amount of a second slag-reducing ingredient. The first slag-reducing ingredient is selected from among one or more oxygenated silicon compounds. The second slag-reducing ingredient is selected from among one or more oxygenated aluminum compounds.

Further according to the present disclosure, there is a treated coal. The treated coal is made up of the coal and an amount of an externally introduced first slag-reducing ingredient and an amount of an externally introduced second slag-reducing ingredient. The first slag-reducing ingredient is selected from among one or more oxygenated silicon compounds. The second slag-reducing ingredient is selected from among one or more oxygenated aluminum compounds.

DETAILED DESCRIPTION OF THE DISCLOSURE

Figure 1:
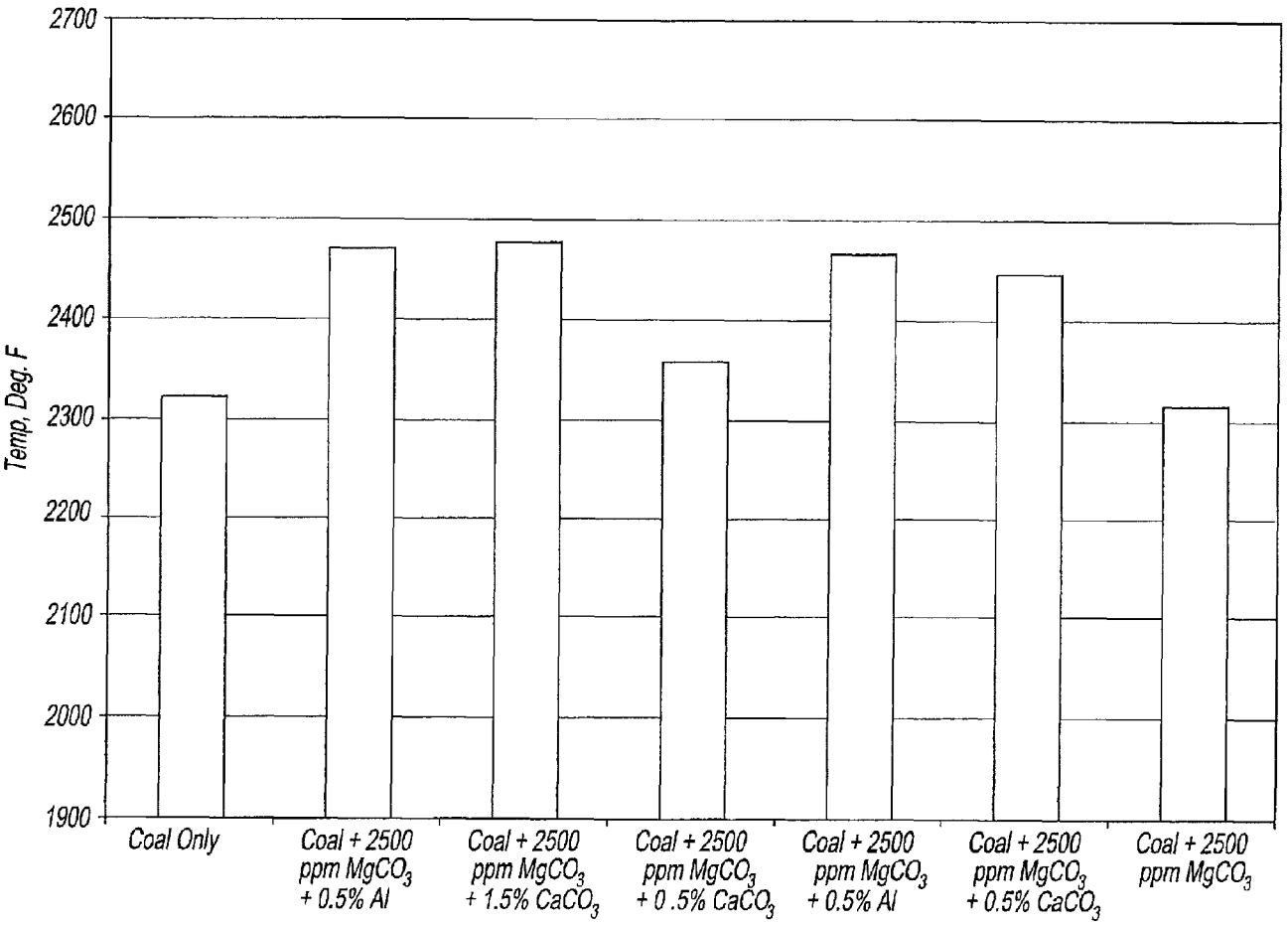
FIG. 1 is a bar graph showing the relative fusion temperatures of coal only, a control of coal plus magnesium carbonate, and coal plus combinations of magnesium carbonate and calcium carbonate or aluminum nitrate nonohydrate.
Figure 2:
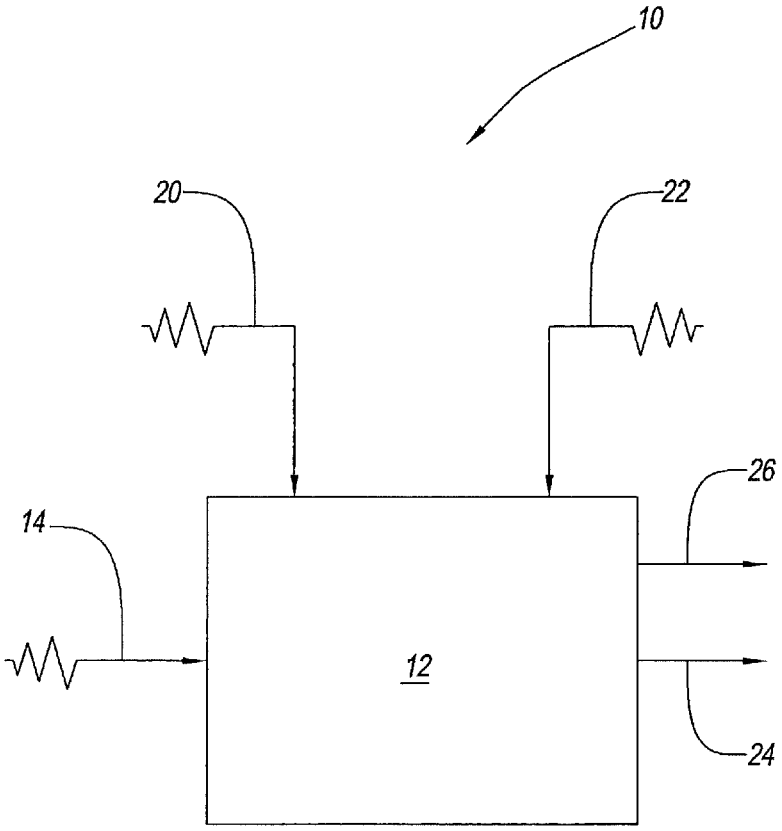
FIG. 2 is a schematic representation of a boiler system useful in carrying out the present invention.

The present disclosure affords reduced slagging in the operation of coal-fired furnaces. Combinations of oxygenated compounds are employed to effect synergistic reductions in slagging.

The combinations of slag-reducing agents are useful with any type of coal, such as anthracite, bituminous, sub-bituminous, and lignite coals. A frequently used type of bituminous coal is ILB (Illinois Basin). A frequently used type of sub-bituminous coal is PRB (Powder River basin).

The first slag-reducing ingredient functions to reduce slag formation relative to combustion without such first slag-reducing ingredient. The first slag-reducing ingredient may also function as a combustion catalyst to improve the oxidation of the coal.

The second slag-reducing ingredient acts synergistically with the first slag-reducing ingredient to significantly reduce slag formation relative to combustion with the first slag-reducing ingredient alone. The rate of formation of slag with the second slag-reducing ingredient is preferably reduced by a factor of about 10 to about 100 compared to the presence of the first slag-reducing ingredient alone. Slag formation and the rate of slag formation can be measured by techniques known in the art, such as high-temperature probe disclosed in U.S. 2008/0291965, which is incorporated herein by reference. The probe uses temperature differential as a function of time to ascertain slag formation and deposition.

In one embodiment, the first slag-reducing ingredient is selected from among one or more oxygenated magnesium compounds. Examples of magnesium compounds include magnesium carbonate, magnesium hydroxide, magnesium sulfate, magnesium oxide, and combinations thereof. A preferred first slag-reducing ingredient is magnesium hydroxide. The second slag-reducing ingredient is selected from among one or more oxygenated calcium compounds, one or more oxygenated silicon compounds, and combinations thereof. Examples of oxygenated calcium compounds include calcium oxide, calcium hydroxide, calcium carbonate, calcium nitrate, and calcium acetate, and combinations of any of the foregoing. Examples of oxygenated silicon compounds include silicon dioxide, silicon monoxide, siloxanes, silanols, silanediols, silicic acids, and combinations thereof.

The above embodiment, which employs combinations of oxygenated magnesium compounds and oxygenated calcium and/or silicon compounds, is useful with any type of coal but is particularly efficacious with ILB (Illinois Basin) bituminous coal.

In another embodiment, the first slag-reducing ingredient is selected from among one or more of the aforementioned oxygenated silicon compounds. The second slag-reducing ingredient is selected from among one or more oxygenated aluminum compounds. Examples of oxygenated aluminum compounds include aluminum nitrate, aluminum oxide, and aluminum hydroxide.

The above embodiment, which employs combinations of oxygenated silicon compounds and oxygenated aluminum compounds, is useful with any type of coal but is particularly efficacious with lignite coal and low-rank bituminous coals having ash content and mineral compositions similar to lignite coal.

In some embodiments, slag-reducing ingredients are added to the coal in amounts preferably up to about 4000 ppm and more preferably up to about 2000 ppm based upon the weight of ash in the coal, which is typically about 2 wt % to about 3 wt % of the total weight of the coal. The composition and proportion of ash in the coal will vary from coal sample to coal sample. The indicated upper limits for amounts of slag-reducing agents are preferred due to economic considerations, but higher amounts are operable and possible. In another embodiment, about 100 ppm to about 1000 ppm of slag-reducing ingredients based upon the weight of the coal as received can be used. In yet another embodiment, about 500 ppm to about 750 ppm of slag-reducing ingredients based upon the weight of the coal as received can be used. Slag-reducing ingredients are preferably employed in amounts sufficient to raise the ash fusion temperature of the coal. Higher ash fusion temperatures are associated with reduced slagging. In some embodiments, the ratio of the first slag-reducing ingredient to the second slag-reducing ingredient preferably ranges from about 95:5 to about 60:40 and more preferably about 90:10 to about 50:50.

In a particular embodiment, the coal treated is a bituminous coal typically have metals ratios (prior to blending with slag-reducing agents) of the following: an Si/Al ratio of about 2.19 to about 2.85; an Fe/(Si+Al) ratio of about 0.12 to about 0.32; and a Ca/(Si+Al) ratio of about 0.04 to about 0.09. Metal contents are determined according to the ASTM coal ash mineral test. Such ratios relate to the metals content encountered in ILB coal. In this embodiment, the first slag-reducing ingredient and the second slag-reducing ingredient are preferably added to the coal ranges at a ratio of about 60:40 to about 40:60 with the first slag-reducing ingredient being one or more oxygenated magnesium compounds and the second slag-reducing ingredient being one or more oxygenated calcium compounds (ratios outside this range are less preferred but operable). The slag-reducing ingredients are added to the bituminous coal in amounts preferably up to about 4000 ppm and more preferably up to about 2000 ppm based upon the weight of ash in the bituminous coal, which is typically about 2 wt % to about 3 wt % of the total weight of the bituminous coal. The composition and proportion of ash in the bituminous coal will vary from coal sample to coal sample. The indicated upper limits for slag-reducing ingredients are preferred due to economic considerations, but higher amounts are operable and possible. In another embodiment, about 100 ppm to about 1000 ppm of slag-reducing ingredients based upon the weight of the bituminous coal as received can be used. In another embodiment, about 500 ppm to about 750 ppm of slag-reducing ingredients based upon the weight of the bituminous coal as received can be used. Slag-reducing ingredients are preferably employed in amounts sufficient to raise the ash fusion temperature of the bituminous coal.

Optionally, additional oxygenated slag-reducing ingredients may be added to the first and second oxygenated slag-reducing ingredients to achieve further reduction in slagging and further synergies. For instance, an oxygenated magnesium compound(s) may be added to the oxygenated silicon compound(s) and the oxygenated aluminum compound(s) to form a combination with oxygenated compounds of three different metals (Mg+Si+Al). Another combination is adding an oxygenated aluminum compound(s) to the oxygenated magnesium compound(s) and the oxygenated calcium compound(s) and/or oxygenated silicon compound(s) to form a combination with oxygenated compounds of three or four different metals (Al+Mg+Ca and/or Si). Other slag-reducing ingredients that may be employed with the first and second oxygenated slag-reducing ingredients include oxygenated copper compounds and ammonium phosphate. Useful oxygenated copper compounds include copper acetate, copper nitrate, copper oxide, and copper carbonate.

The slag-reducing ingredients may be added directly into the furnace or boiler in powder or liquid forms or added to the coal as received prior to conveyance of the coal to the furnace or boiler. If desired, the ingredients may be added at a burner(s) directly into a flame(s) via coal feeders or coal pipes. Suitable liquid forms include solutions and slurries. A preferred solvent or vehicle is water. A liquid is preferably sprayed onto the coal prior to bunkering or in gravimetric feeders prior to pulverization or prior to cycloning.

An embodiment of the process of the present disclosure is set forth in FIG. 1 in the form of a boiler system 10. System 10 has a boiler 12. Feed stream 14 provides a conduit for feeding coal, a first additive, and a second additive to boiler 12 through burner 17. Feed streams 20 and 22 provide conduits for feeding water and air, respectively, into boiler 12. Exit stream 24 delivers steam produced in boiler 12. Exit stream 26 delivers exhaust gas. The steam may be employed for purposes of delivering heat or driving a turbine and electrical generator (not shown). Condensed water and/or waste heat may be recycled to boiler system 10 through stream 20 or other conduit (not shown).

The following are examples of the present disclosure and are not to be construed as limiting. All parts and percentages are by weight unless otherwise indicated.

EXAMPLES

Example 1

Mixtures of coal and combinations of slag-reducing ingredients of the present disclosure were prepared and tested for fusion temperature. The results were compared to fusion temperatures obtained for coal only (comparative) and a mixture of coal with only one slag-reducing agent (control). Although not bound by any theory, increasing the fusion temperature of coal is believed to decrease the likelihood of slag formation upon combustion thereof.

The coal employed was Highland, an ILB bituminous coal. Magnesium carbonate ($MgCO_3$) was employed as a slag-reducing agent except in the comparative. Calcium carbonate ($CaCO_3$) and aluminum nitrate nonohydrate were employed alternately as second slag-reducing ingredients except in the control.

The coal and the slag-reducing ingredients were blended in a hopper. Specimens were collected and tested for fusion temperature (final fusion temperature) according to ASTM Ash Fusion Temperature.

The fusion temperatures for the coal only and for coal+$MgCO_3$ were comparable. In contrast, the fusion temperatures of the mixtures of coal and two slag-reducing ingredients ($MgCO_3$ and $CaCO_3$) of the present disclosure were markedly higher by at least 100° F. compared to the control with only one slag-reducing agent. The difference in fusion temperature between mixtures with one versus two slag-reducing ingredients demonstrates the synergistic effect of employing two slag-reducing ingredients. Results are set forth in FIG. 1.

Example 2

Mixtures of coal and combinations of slag-reducing ingredients of the present disclosure were prepared and were burned in a coal-fired furnace. The efficacy of the combination of calcium carbonate plus magnesium carbonate versus magnesium carbonate only (control) was evaluated.

The coal used was an ILB bituminous coal having a metals content falling with the following ratios: an Si/Al ratio of about 2.19 to about 2.85; an Fe/(Si+Al) ratio of about 0.12 to about 0.32; and a Ca/(Si+Al) ratio of about 0.04 to about 0.09. The slag-reducing ingredients used were 1000 ppm Coal Treat 500 (CT-500) (magnesium carbonate) and 1500 ppm Coal Treat 600 (CT-600) (calcium carbonate) (both of EES, Inc.) based on the weight of the coal. In the first portion of the run, both magnesium carbonate and calcium carbonate were added to the coal. In the latter portion of the run, only magnesium carbonate was added to the coal.

Efficacy of slag reduction was evaluated using the tilt position (angle of position) of burners in the furnace. The tilt position of burners is measured in degrees with a tilt of zero degrees being a reference point when a burner is normal or perpendicular to a wall of the furnace. When the burner is tilted upward, the angle is positive, and when the burner is tilted downward, the angle is negative. The wall of the furnace contains heat exchange tubes through which water is circulated. The heat from the furnace causes the water to form steam, which is used to power a generator to generate electricity. When slag forms on the tubes, heat transfer efficiency to the tubes is diminished. To compensate for the diminished efficiency of heat transfer, the control system within the furnace redirects the burner(s) upward to increase the temperature in the upper section of the furnace. The more positive the tilt angle, the greater the diminution in efficiency. A tilt angle of zero or negative indicates that slagging is limited or none.

Figure 3:
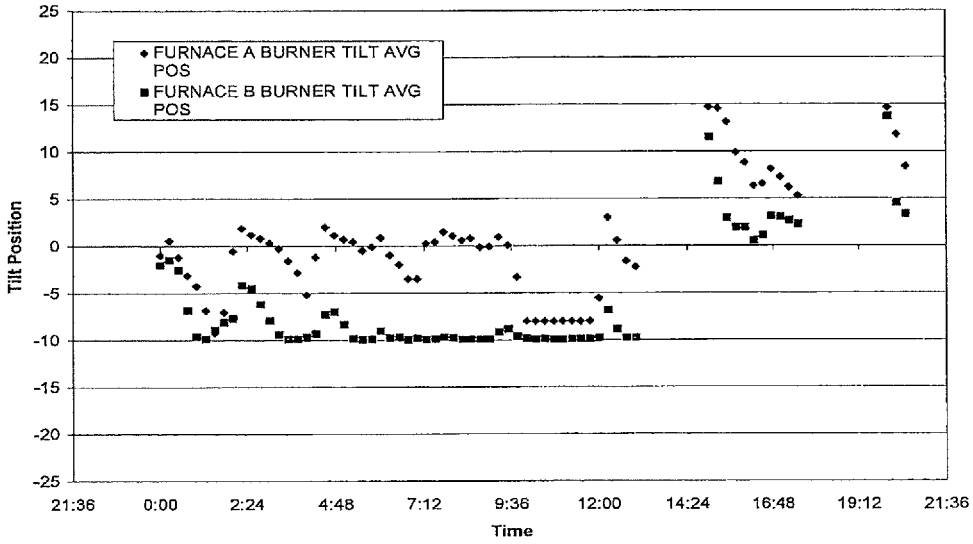
FIG. 3 is a plot of burner tilt position of a boiler system burning a treated ILB bituminous coal of the present invention.

FIG. 3 shows a plot of the tilt angles of two burners in an operating furnace burning the coal mixture described above. For much of the run, the coal contained both the magnesium carbonate and calcium carbonate slag-reducing ingredients and exhibited high levels of heat transfer efficiency as indicated by the negative tilt angles or positive tilt angles in the vicinity of zero. Later in the run, however, only magnesium carbonate was added to the coal (calcium carbonate not added). As shown in FIG. 3, the tilt angles went mostly positive indicating that a substantial degree of slagging had taken place on the tubes. Thus, the furnace operating with reduced slagging and greater efficiency with the combination of magnesium carbonate and the calcium carbonate than with the magnesium carbonate only.

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variances that fall within the scope of the appended claims.

What is claimed is:

1. A process for operating a coal-fired furnace, comprising:

a) providing coal to a coal-fired furnace; and b) combusting the coal in the presence of a first slag-reducing ingredient and a second slag-reducing ingredient in amounts effective to reduce slag formation in the furnace, wherein the first slag-reducing ingredient is one or more oxygenated magnesium compounds, wherein the second slag-reducing ingredient is one of one or more oxygenated silicon compounds and a combination of one or more oxygenated compounds of aluminum and silicon, wherein the coal exhibits an Si/Al ratio of 2.19 to 2.85; a Fe/(Si+Al) ratio of 0.12 to 0.32; and a Ca/(Si+Al) ratio of 0.04 to 0.09.

2. The process of claim 1, wherein the one or more oxygenated magnesium compounds is selected from a group consisting of magnesium carbonate, magnesium hydroxide, magnesium sulfate, magnesium oxide, and combinations thereof.

3. The process of claim 2, wherein the one or more oxygenated magnesium compounds is magnesium hydroxide or magnesium carbonate.

4. The process of claim 1, wherein the second slag-reducing ingredient is one or more oxygenated silicon compounds selected from a group consisting of silicon dioxide, silicon monoxide, siloxanes, silanols, silanediols, silicic acids, and combinations thereof.

5. The process of claim 1, wherein the second slag-reducing ingredient is a combination of one or more oxygenated compounds of aluminum and silicon selected from a group consisting of silicon dioxide, silicon monoxide, siloxanes, silanols, silanediols, silicic acids, aluminum nitrate, aluminum oxides, aluminum hydroxide, and combinations thereof.

6. The process of claim 1, wherein the coal is a bituminous coal.

7. The process of claim 1, wherein the first and second slag-reducing ingredients are added to the coal at up to 2000 ppm by weight based upon the weight of the coal as received.

8. The process of claim 1, wherein the first and second slag-reducing ingredients are present at 100 to 1000 ppm by weight based upon the weight of the coal as received.

9. The process of claim 1, wherein a ratio of the first slag-reducing ingredient to the second slag-reducing ingredient ranges from 95:5 to 60:40.

10. The process of claim 1, wherein a ratio of the first slag-reducing ingredient to the second slag-reducing ingredient ranges from 90:10 to 80:20.

11. The process of claim 1, wherein a rate of formation of slag is reduced by a factor of 10 to 100 compared to a presence of the first slag-reducing ingredient alone.

12. The process of claim 1, wherein the first and second slag-reducing ingredients are added to the coal prior to provision of the coal to the furnace.

13. The process of claim 1, wherein the first and second slag-reducing ingredients are added to the furnace.

14. The process of claim 1, wherein a ratio of the first slag-reducing ingredient to the second slag-reducing ingredient added to the coal ranges from 60:40 to 40:60.

15. A method for treating coal, comprising:

adding to the coal an amount of a first slag-reducing ingredient and an amount of a second slag-reducing ingredient, wherein the first slag-reducing ingredient is one or more oxygenated magnesium compounds, wherein the second slag-reducing ingredient is selected from a group consisting of one or more oxygenated silicon compounds and a combination of one or more oxygenated compounds of aluminum and silicon, and wherein the coal exhibits an Si/Al ratio of 2.19 to 2.85; a Fe/(Si+Al) ratio of 0.12 to 0.32; and a Ca/(Si+Al) ratio of 0.04 to 0.09.

16. The method of claim 15, wherein a ratio of the first slag-reducing ingredient to the second slag-reducing ingredient added to the coal ranges from 60:40 to 40:60.

17. A method for reducing slag formation in a coal-fired furnace, comprising combusting coal in the furnace when a slag-reducing ingredient is present, wherein the coal exhibits an Si/Al ratio of 2.19 to 2.85; a Fe/(Si+Al) ratio of 0.12 to 0.32; and a Ca/(Si+Al) ratio of 0.04 to 0.09, and wherein the slag-reducing ingredient comprises a combination of one or more oxygenated compounds of aluminum and silicon.

18. The method of claim 17, wherein the coal is a bituminous coal.

* * * * *